US009962568B2

(12) United States Patent
Taniguchi et al.

(10) Patent No.: US 9,962,568 B2
(45) Date of Patent: May 8, 2018

(54) FIRE DETECTION TUBE USED FOR AUTOMATIC FIRE EXTINGUISHING DEVICE AND THE AUTOMATIC FIRE EXTINGUISHING DEVICE

(71) Applicants: NICHIBOU CO., LTD., Tokyo (JP); MITSUI CHEMICALS INDUSTRIAL PRODUCTS LTD., Tokyo (JP)

(72) Inventors: Kenji Taniguchi, Tokyo (JP); Masaya Iwasaki, Otake (JP); Yuichi Kouga, Tokyo (JP)

(73) Assignees: NICHIBOU CO., LTD., Tokyo (JP); MITSUI CHEMICALS INDUSTRIAL PRODUCTS LTD., Tokyo (JP)

( * ) Notice: Subject to any disclaimer, the term of this patent is extended or adjusted under 35 U.S.C. 154(b) by 87 days.

(21) Appl. No.: 14/647,934

(22) PCT Filed: Sep. 12, 2014

(86) PCT No.: PCT/JP2014/074209
§ 371 (c)(1),
(2) Date: Oct. 19, 2015

(87) PCT Pub. No.: WO2016/038732
PCT Pub. Date: Mar. 17, 2016

(65) Prior Publication Data
US 2016/0074686 A1 Mar. 17, 2016

(51) Int. Cl.
*A62C 37/14* (2006.01)
*A62C 35/02* (2006.01)
(Continued)

(52) U.S. Cl.
CPC ..... *A62C 35/023* (2013.01); *A62C 3/00* (2013.01); *A62C 3/008* (2013.01); *A62C 3/07* (2013.01);
(Continued)

(58) Field of Classification Search
CPC ... A62C 35/023; A62C 99/0018; A62C 37/11; A62C 35/13; A62C 37/04; A62C 3/00;
(Continued)

(56) References Cited

U.S. PATENT DOCUMENTS 3,827,502 A * 8/1974 Lockwood ..... A62C 35/10 169/26
4,194,572 A * 3/1980 Thery ..... A62C 3/06 169/9
(Continued)

FOREIGN PATENT DOCUMENTS

JP 01-144061 A 6/1989
JP 3170412 B2 5/2001
(Continued)

*Primary Examiner* — Steven J Ganey
(74) *Attorney, Agent, or Firm* — Westerman, Hattori, Daniels & Adrian, LLP

(57) ABSTRACT

The present invention provides an automatic fire extinguishing device that can detect a fire at the temperature lower than 120 degrees Celsius and that can be installed for a long term in a state of maintenance-free.

The fire extinguishing device consists of a pressure resistant container filled with the extinguishant and the pressurization agent, the container valve attached to the opening of the pressure resistant container, the fire detection tube connected to the container valve. And the fire detection tube is formed with the lamination of the tubular base resin layer and the gas barrier layer, the base resin layer is made of the thermoplastic resin and the gas barrier layer is made of ethylene vinyl alcohol copolymer resin (EVOH resin).

6 Claims, 6 Drawing Sheets

(51) Int. Cl.

| | |
|---|---|
| ***A62C 3/00*** | (2006.01) |
| ***A62C 37/36*** | (2006.01) |
| ***A62C 35/00*** | (2006.01) |
| ***A62C 3/07*** | (2006.01) |
| ***A62C 35/13*** | (2006.01) |
| ***A62C 13/62*** | (2006.01) |
| ***A62C 37/11*** | (2006.01) |
| *A62C 99/00* | (2010.01) |

(52) U.S. Cl.
CPC ..... *A62C 13/62* (2013.01); *A62C 35/00* (2013.01); *A62C 35/13* (2013.01); *A62C 37/04* (2013.01); *A62C 37/11* (2013.01); *A62C 99/0018* (2013.01)

(58) Field of Classification Search
CPC ..... A62C 3/008; A62C 3/074; A62C 35/00; A62C 13/62; A62C 3/07
USPC ..... 169/9, 11, 16, 56, 57, 58, 62; 428/36.91, 428/35.7, 36.9
See application file for complete search history.

(56) References Cited

U.S. PATENT DOCUMENTS

| | | | | |
|---|---|---|---|---|
| 5,909,776 | A * | 6/1999 | Stewart | A62C 35/10 169/26 |
| 6,161,624 | A * | 12/2000 | Bennett | A62C 35/10 169/58 |
| 8,067,075 | B2 * | 11/2011 | Nishioka | B32B 1/08 428/35.7 |
| 8,657,022 | B2 * | 2/2014 | Smith | A62C 37/48 169/62 |
| 8,851,197 | B2 * | 10/2014 | Smith | A62C 37/48 169/62 |

FOREIGN PATENT DOCUMENTS

| | | |
|---|---|---|
| JP | 2002-282381 A | 10/2002 |
| JP | 2006-288688 A | 10/2006 |

* cited by examiner

FIRE DETECTION TUBE USED FOR AUTOMATIC FIRE EXTINGUISHING DEVICE AND THE AUTOMATIC FIRE EXTINGUISHING DEVICE

TECHNICAL FIELD

The present invention relates to an automatic fire extinguishing device using a synthetic resin tube as a fire detection means (fire detection tube) and this fire detection tube of this automatic fire extinguishing device.

BACKGROUND ART

As for this kind of automatic fire extinguishing device, the automatic fire extinguishing device of direct system and the automatic fire extinguishing device of indirect system are known. As shown in FIG. 5, the automatic fire extinguishing device of direct system is comprised of the pressure resistant container 10 filled with extinguishant and pressurization agent, the container valve 12 attached to the opening of the pressure resistant container 10 and fire detection tube 14 connected to the container valve 12.

As shown in FIG. 6, the automatic fire extinguishing device of indirect system is comprised of the pressure resistant container 10 filled with extinguishant and pressurization agent, the container valve 12 attached to the opening of the pressure resistant container 10, the fire detection tube 14 connected to the container valve 12 and the jet nozzle 26 connected through the extinguishant supplying tube 24 to the container valve 12.

As materials of the fire detection tube 14, the synthetic resin, e.g. polyamide resin, is used. Because if the synthetic resin is used as the materials, the pressurization agent is hard to leak out from the tube and in case of a fire the tube becomes weak due to the heat of the fire and the weakened part is ruptured by the pressure of the pressurization agent and a hole would be open.

These automatic fire extinguishing devices are installed in a fire dangerous area (where there is a risk of a fire) such as a wind-power generator, an escalator machine room, a switchboard, a distribution board, a transformer, the engine room of the car, the engine room of the ship, the engine room of the heavy industrial machine for the construction. And the fire detection tube 14 of the automatic fire extinguishing device is installed in the meander condition in this device.

As explained next, these automatic fire extinguishing devices are able to detect the fire and extinguish the fire automatically.

In other words, when a fire breaks out in somewhere in the fire dangerous area, the fire detection tube 14 becomes weak by the heat of the fire, and this weakened part is ruptured by the pressure of the pressurization agent, and a hole is open on the fire detection tube 14, and the pressurization agent in the fire detection tube 14 is jetted out, and the pressure in the fire detection tube 14 becomes low.

In case of the fire extinguishing device of the direct system, the inside of the pressure resistant container 10 is communicated with the inside of the fire detection tube 14 each other by the container valve 12. When the inside pressure of the fire detection tube 14 becomes low, the fire extinguishant inside of the pressure resistant container 10 is supplied to a hole of the fire detection tube. Then the fire extinguishant is jetted out from the hole on the fire detection tube with the pressurization agent and the fire is put out by the extinguishant which is jetted out to the source of the fire.

In case of the automatic fire extinguishing device of the indirect system, the injection nozzle 26 is connected to the container valve 12 through the extinguishant tube 24 which is a different system of the fire detection tube 14, when the inside pressure of the fire detection tube 14 becomes low, the container valve 12 which supplies the extinguishant to the injection nozzle 26 is open. The extinguishant inside of the pressure resistant container is supplied to the injection nozzle 26 by the pressurization agent. The fire is put out by the extinguishant which is jetted out to the source of the fire with the pressurization agent from the injection nozzle 26.

These automatic fire extinguishing devices would not produce electric sparks during fire detecting operations because they do not use electricity to detect and extinguish a fire. Therefore, when these automatic fire extinguishing devices are installed in the place surrounded by many flammable gas and dust, there is no worrying factor of explosion by catching a fire on the flammable gas or dust. Thus, there is the advantage that these automatic fire extinguishing devices can be used safely even in the explosion proof area.

In addition, these automatic fire extinguishing devices do not detect the occurrence of a fire optically. And they detect the fire by a hole opening on the synthetic resin fire detection tube by the heat of the fire. Therefore, even if the fire detection tube working as a sensor becomes dirty with long-term setting, there is an advantage that the fire detection function of these automatic fire extinguishing devices would not deteriorate and there is no fear that they do not function properly.

In addition, this automatic fire extinguishing device does not use a sensor nor a control unit using the electricity and the fire detection tube becomes the sensor and the fire extinguishant would be carried to the source of the fire automatically. Therefore these automatic fire extinguishing devices have the advantages of extinguishing the fire immediately even in case of the power supply loss caused by the blackouts and so on.

In addition, a battery is not necessary as a power supply because this automatic fire extinguishing device does not use a sensor and a control unit which is operated by the electricity, and thus also there is no need of exchange of batteries or any need of maintenance. Therefore, this automatic fire extinguishing device has the advantage of not worrying about the function stop of the sensor and control unit due to the natural discharge of the battery while installed for a long term.

This kind of automatic fire extinguishing device has various advantages as mentioned above. However, the fire detection tube used in this kind of the automatic fire extinguishing device is made of synthetic resin. Therefore, this fire detection tube is not able to shut off the leakage of the pressurization agent completely such as nitrogen gas and when this device is installed for a long term, the pressure agent leaks by penetrating through the fire detection tube and the pressure of the pressure container and the pressure inside of the fire detection tube becomes low.

When the pressure of the pressure container and inside of the fire detection tube reduces, in case of a fire, the extinguishant might not be able to be jetted out with enough force. Therefore, the pressure of the pressure container and inside of the fire detection tube should be checked in every fixed period of time, and if the reduction of the pressure is remarkable, the pressurization agent must be replenished to inside of the pressure container. However, the automatic fire extinguishing device tends to be installed in the place difficult to access and in the small place, it is very troublesome to perform the maintenance of automatic fire extinguishing device in such a place frequently.

Therefore it is desirable that the fire detection tube in which the pressurization gas hardly leaks for a long term such as 5 to 10 years and also that it has a characteristic of being ruptured easily by the heat of the fire.

PRIOR ART DOCUMENTS

Patent Document

Patent Document 1: Utility Model Registration No. 3170412

Patent Document 2: Japanese Patent Publication No. 2006-288688

Patent Document 3: Japanese Patent Publication No. 2002-282381

Patent Document 4: Japanese Patent Publication No. Heisei 1-144061

DISCLOSURE OF THE INVENTION

Problems to be Solved by the Invention

In recent years hybrid cars and electric vehicles equipped with the lithium ion battery are sold and used. If malfunction happens to the lithium ion battery, it might catch a fire and produce a fire, because the lithium ion battery installed in the car has a large-capacity. While driving a car on expressway and if the driver cannot stop the car immediately and the driver cannot escape from the car, it is very dangerous. Therefore, when the lithium ion battery installed in the car is overheated and might catch a fire, a fire extinguishing device which extinguish the fire immediately is required.

In addition, as inside of the engine room of a car is small and dirty, the use of the above mentioned type of the automatic fire extinguishing device which is able to operate surely in such a severe environment is considered. However, the rupture and activation temperature of the conventional fire detection tube made of PA (polyamide) resin is at around 180 degrees Celsius, whereas the demanded rupture and activation temperature of the fire detection tube in case of the detection of the overheat and inflammation of the lithium ion battery and extinguishing a fire is lower than 120 degrees Celsius. Therefore, the conventional PA resin fire detection tube cannot be used.

There are various synthetic resin of which rupture-activation temperature is at lower than 120 degrees Celsius are known. But these synthetic resin materials cannot be used for the fire detection tube because the gas barrier properties of these materials are extremely bad. In other words, the fire detection tube of which activation temperature is low enough at around 120 degrees Celsius and which hardly leaks the pressurization agent (nitrogen gas) for a long term and of which gas barrier properties are high is not known.

The problem to be solved by the present invention is to provide a fire detection tube whose activation temperature is lower than 120 degrees Celsius, which hardly leaks the pressurization gas (nitrogen gas) for a long term, and which has high gas barrier properties.

Means for Solving the Problem

The present invention solving the above problem is characterized in that it uses the fire detection tube consisting of the tubular base resin, the gas barrier layer laminated coaxially with the above base resin layer, the above base resin layer made of thermoplastic resin and the gas barrier layer consisting of ethylene-vinyl alcohol copolymer resin (EVOH resin).

The automatic fire extinguishing device of the present invention is comprised of the pressure resistant container which holds the extinguishant, the pressurization agent inside, the container valve attached to the opening of the pressure resistant container and the fire detection tube connected to the container valve. This fire detection tube is comprised of laminates which the base resin layer and the gas barrier layer laminated. The gas barrier and the base resin layer become one laminating through the adhesive layer.

Preferably the base resin layer is being laminated on to both sides of the gas barrier layer, but it is acceptable if the base resin layer is being laminated on to only one side of the gas barrier layer. In case that the base resin layer is laminated on both sides of the gas barrier layer, the gas barrier layer is protected by both sides. Therefore, there is an advantage in being able to prevent from the permeation and the disappearance of the pressurization agent even when the gas barrier layer is damaged. As the materials of the adhesive layer, Polyolefin resin denaturalized by the functional group such as maleic anhydride can be used.

As for the thickness of the gas barrier layer, 0.005 mm~0.1 mm is preferable. If the thickness of the gas barrier layer is 0.005 mm~0.1 mm, the pressurization gas can be blocked for a long term. And if the temperature rises to 90~120 degrees Celsius, the pressurization gas can be jetted out and extinguish a fire immediately. But even if the thickness of the gas barrier layer is less than 0.005 mm, it can be used. Because if the thickness is between the range of 0.002 mm to 0.005 mm, there is no leak of the pressurization gas, therefore it can be used enough under the certain conditions.

In addition, as for the thickness of the base resin layer, 1 mm~2 mm is preferable. If the thickness of the above base resin layer is 1 mm~2 mm, the responsiveness of the base resin layer for the fire is good and also the mechanical strength of the fire detection tube is trustworthy. But even in case that the thickness of the base resin layer is out of this range (e.g. 1 mm~2 mm), the fire extinguishing device can be used depending on the object to be extinguished of, or if the diameter of the fire detection tube is altered.

As for the materials of the base resin layer, polyethylene resin, polypropylene resin and other polyolefin resin can be used. When the material of the base resin layer is polyethylene resin or polypropylene resin or other polyolefin resin, there is an advantage that the fire detection tube is ruptured by the fire immediately and the fire is extinguished quickly.

As for the kind of the polyethylene resin, it is preferable that the density of the polyethylene resin is from 930 $kg/m^3$~960 $kg/m^3$. When the density of the polyethylene resin is from 930 $kg/m^3$~960 $kg/m^3$, there is an advantage that the domain of the creep performance and the flexibility is secured.

Advantageous Effect of the Invention

The present invention discloses that the base resin layer of the fire detection tube is the thermoplastic resin, and that the gas barrier layer consisting of the EVOH resin laminates to this base resin layer. Therefore it is effective that the leak of the pressurization gas is prevented for a long term, that the fire detection tube is ruptured at the temperature lower than 120 degrees Celsius, and that the detecting and that extinguishing a fire can be done responsively.

In addition, as for the present invention, the inside of the fire detection tube and the inside of the pressure resistant container are kept at the desired pressure because the pressurization gas is hardly leaked out from the fire detection tube. Therefore, it is effective that the automatic fire extinguishing device can be installed in a maintenance free condition for a long term.

BEST MODE FOR CARRYING OUT THE INVENTION

We achieved the purpose of providing the fire detection tube being good at the fire responsiveness of the activation temperature being lower than 120 degrees Celsius and of providing the automatic fire extinguishing device using this fire detection tube by the simple structure without losing the gas barrier capacity.

Embodiment 1

(1) An Experiment that Supports the Fact that the Fire Detection Tube of the Present Invention is Able to Rupture and to Extinguish a Fire at the Temperature of Lower than 120 Degrees Celsius (A) the Fire Detection Tube Used for the Experiment The fire detection tubes used for the experiment are the testing specimen 1~4. As for the testing specimen 1~4, the inside diameter is 4 mm, the outer diameter is 6 mm and the full length is 2000 mm. Nitrogen gas (N2) is filled with the inside of the testing specimen 1~4, and the both ends of the testing specimen 1~4 are sealed by the thermo compression. And the internal pressure of the testing specimen 1~4 is 1.8 Mpa.

Figure 1:
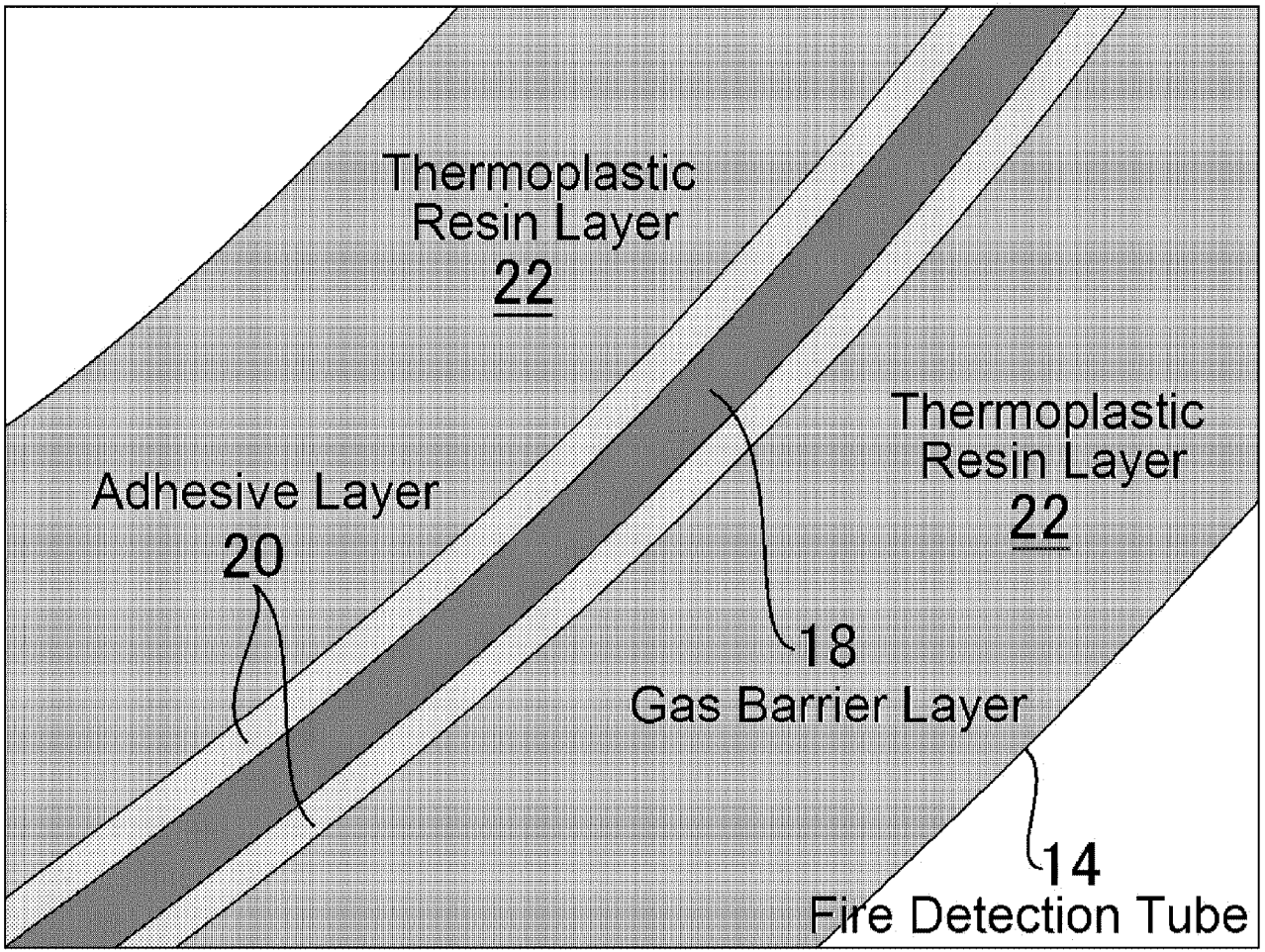
FIG. 1 is an illustration indicating the cross sectional structures of the fire detection tube for the automatic fire extinguishing devices of the present invention.

As indicated on FIG. 1, as for the testing specimen 1 and 2, the lamination which is laminated the both sides of the gas barrier layer 18 made of the EVOH resin with the base resin layer 22 made of the PE resin through the adhesive layer 20 is used. As for the material of the adhesive layer 20, Polyolefin resin denaturalized by the functional group such as maleic anhydride is used. The thickness of the gas barrier layer 18 is 0.005 mm. As for the material of the testing specimen 3 and 4, PA resin is used as a whole.

(B) The Heating Apparatus Used for the Experiment

Name of the Maker: Kato Inc.

Name of the Product: Silvery Emperor

Type of the Model: SSE-45K-A (C) The Conditions of the Experiment

The ruptured temperature and the duration time are examined by the conditions of the testing specimen 1~4 in the heating apparatus being heated by 3 degrees Celsius/min from the temperature of 24 degrees Celsius. The upper limit of the heating temperature is 190 degrees Celsius.

(D) The Result of the Experiment

Figure 2:
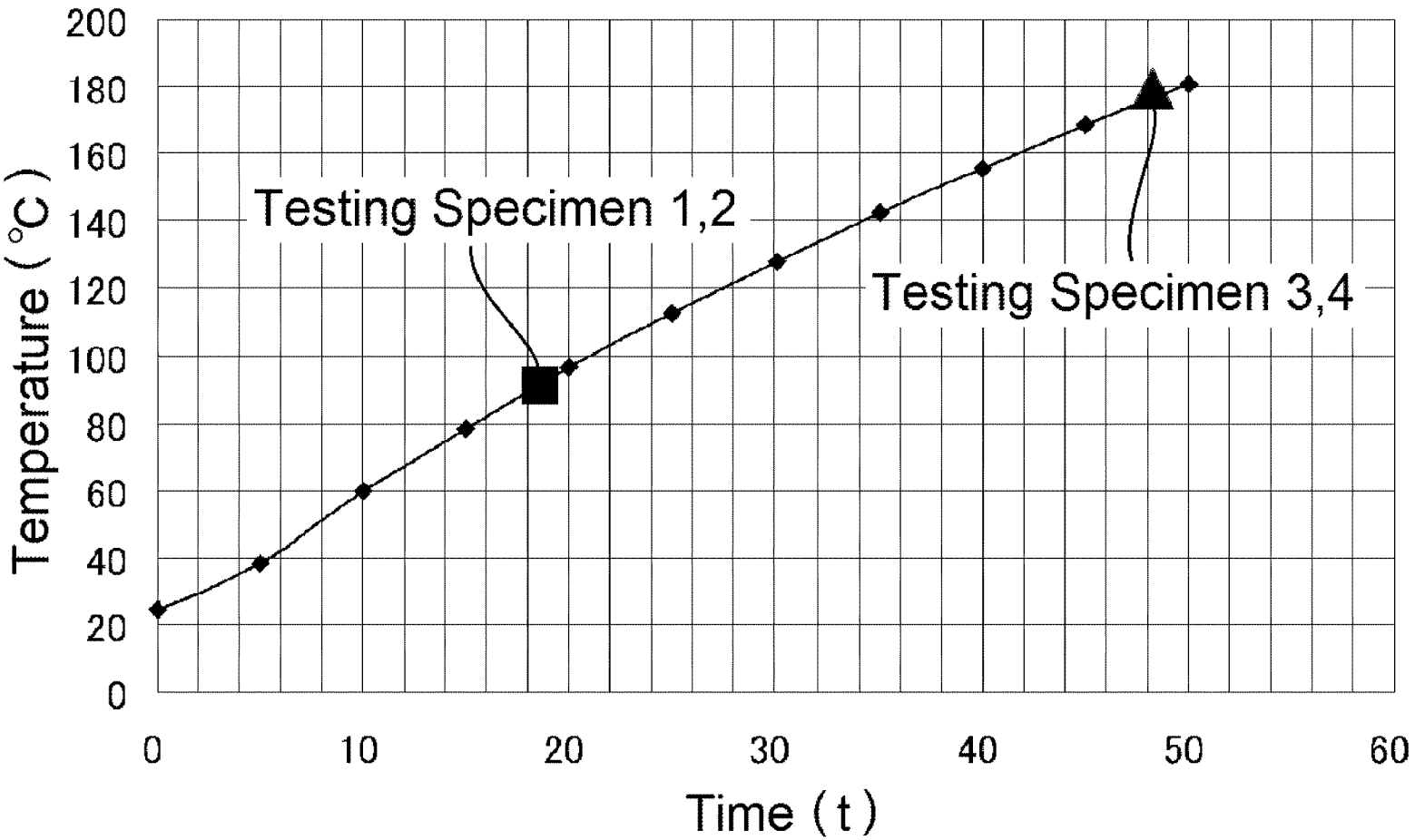
FIG. 2 is temperature of the inside of the heating apparatus and a graph indicating relations with the time.

The result of the experiment is indicated on Table 1 and FIG. 2.

TABLE 1

| Testing Specimen | Quantity of Pressurization(Mpa) | Operation Temperature(° C.) | Operation Time |
|---|---|---|---|
| 1 | 1.8 | 92 | 18 min. 50 sec. |
| 2 | 1.8 | 92 | 18 min. 50 sec. |
| 3 | 1.8 | 179 | 48 min. 30 sec. |
| 4 | 1.8 | 179 | 48 min. 40 sec. |

The rupturing temperature of the fire detection tube of the testing specimen 3 and 4 at the embodiment 1 is around 90 degrees Celsius whereas the explosion temperature of the fire detection tube of the testing specimen 1 and 2 at embodiment 1 is around 180 degrees Celsius. Therefore it is proved that the fire detecting tube of the embodiment can be activated immediately at the temperature of lower than 120 degrees Celsius.

(2) The Inspection of the Fact Having the Sufficient Gas Barrier Property of the Fire Detection Tube of the Present Invention Using various kinds of materials for the gas barrier layer and putting the pressure to the inside of the fire detection tube consisting of these gas barrier layer by the nitrogen gas, we tried to obtain the relationship between the pressure inside of the fire detection tube and the lapsing time (years). As for the fire detecting tube, the length is 10 m, the central diameter of the tube is 5 mm, surface area of the tube is 157079.6 mm2/10 m, the inner diameter of the tube is 4 mm and the content volume (inner capacity) is 125663.7 mm3/10 m. The pressure of the inside of the fire detection tube is 1.8 MPa.

As for the materials of the gas barrier layer, EVOH resin, PET resin, PAN resin and PVDC resin are used. The thickness of the gas barrier layer consisting of EVOH resin is 0.005 mm. The thickness of the gas barrier layer consisting of PET resin, the gas barrier layer consisting of PAN resin and the gas barrier layer consisting of PVCD resin are 0.1 mm all. For the comparison example the fire detection tube consisting of PA resin (thickness is 1 mm) is also used.

As for the nitrogen permeability rate, EVOH resin is 0.017 cc·20 μm/($m^2$·day·atm), PET resin is 8 cc·20 μm/($m^2$·day·atm), PAN resin is 5 cc·20 μm/($m^2$·day·atm), PVDC resin is 6 cc·20 μm/($m^2$·day·atm) and PA resin is 12 cc·20 μm·($m^2$·day·atm).

Figure 3:
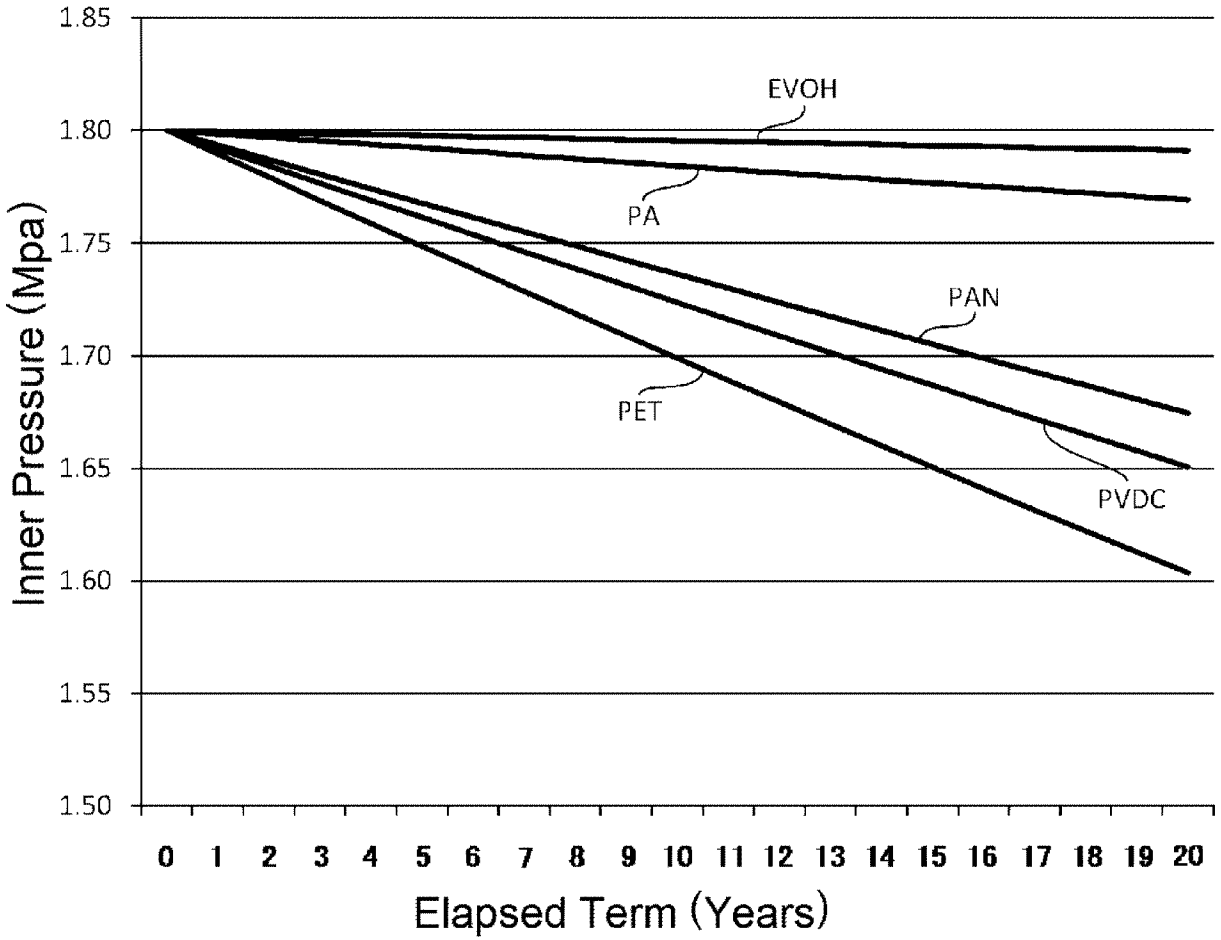
FIG. 3 is a graph indicating the changes of the internal pressure of the fire detection tube having the barrier layer consisting of the various synthetic resins.

Trying to obtain a relationship between the pressure of the inside of the fire detection tube and the lapse of the years under the conditions above, the result is shown as FIG. 3. The result indicated on FIG. 3 shows that the fall of the pressure of the fire detection tube which laminated the gas barrier layer consisting of the EVOH resin is lower for a long time than the fall of the pressure of the fire detection tube which laminated the gas barrier layer consisting of the PET resin, PAN resin or PVDC resin. And in comparison with decline of the pressure of the fire detection tube consisting of the polyamide resin, the decline of the pressure of the fire detecting tube laminated the gas barrier layer consisting of the EVOH resin is less for a long time is found.

Figure 4:
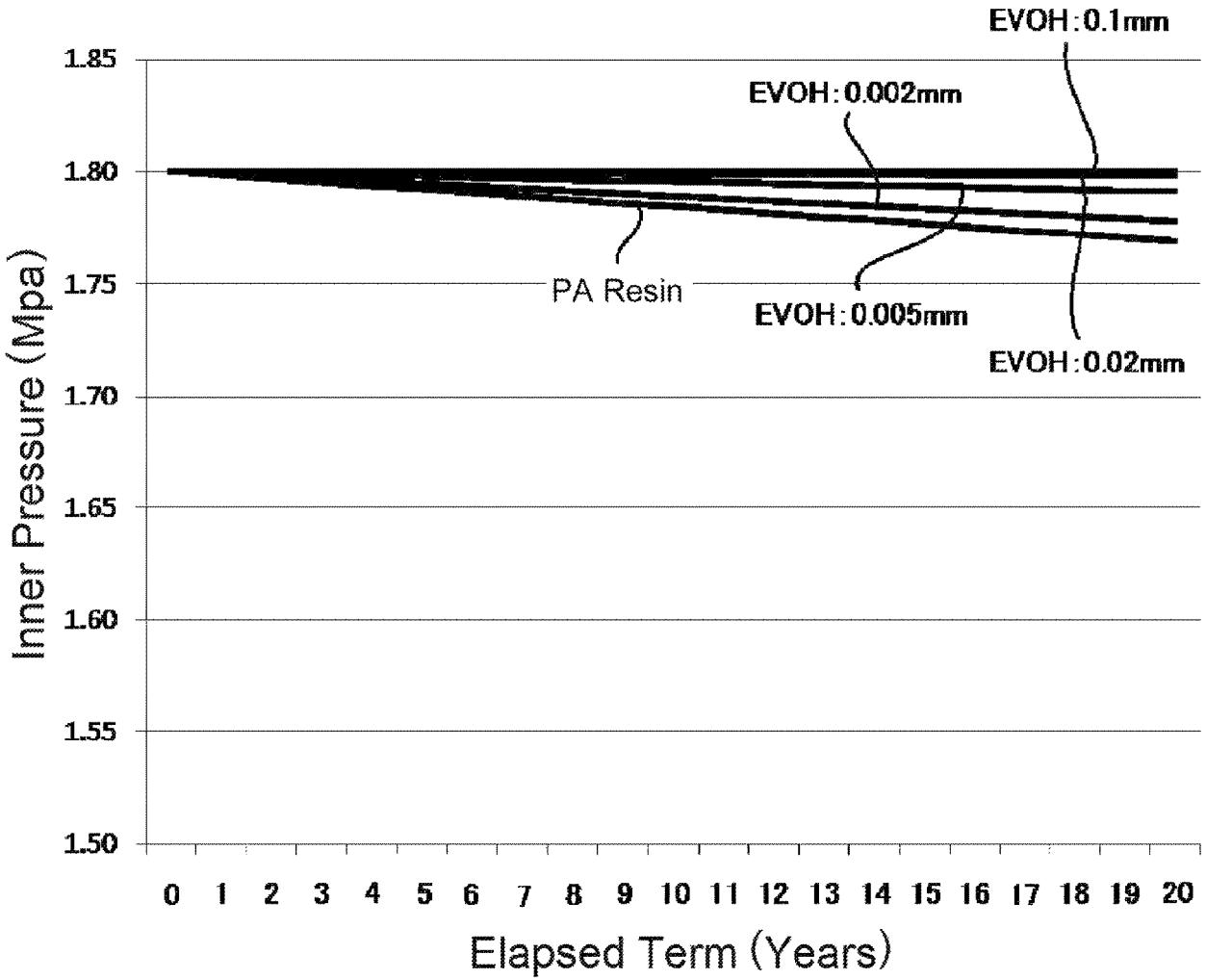
FIG. 4 is a graph indicating the changes of the internal pressure of the fire detection tube having the barrier layer consisting of the EVOH resin having different thickness.
Figure 5:
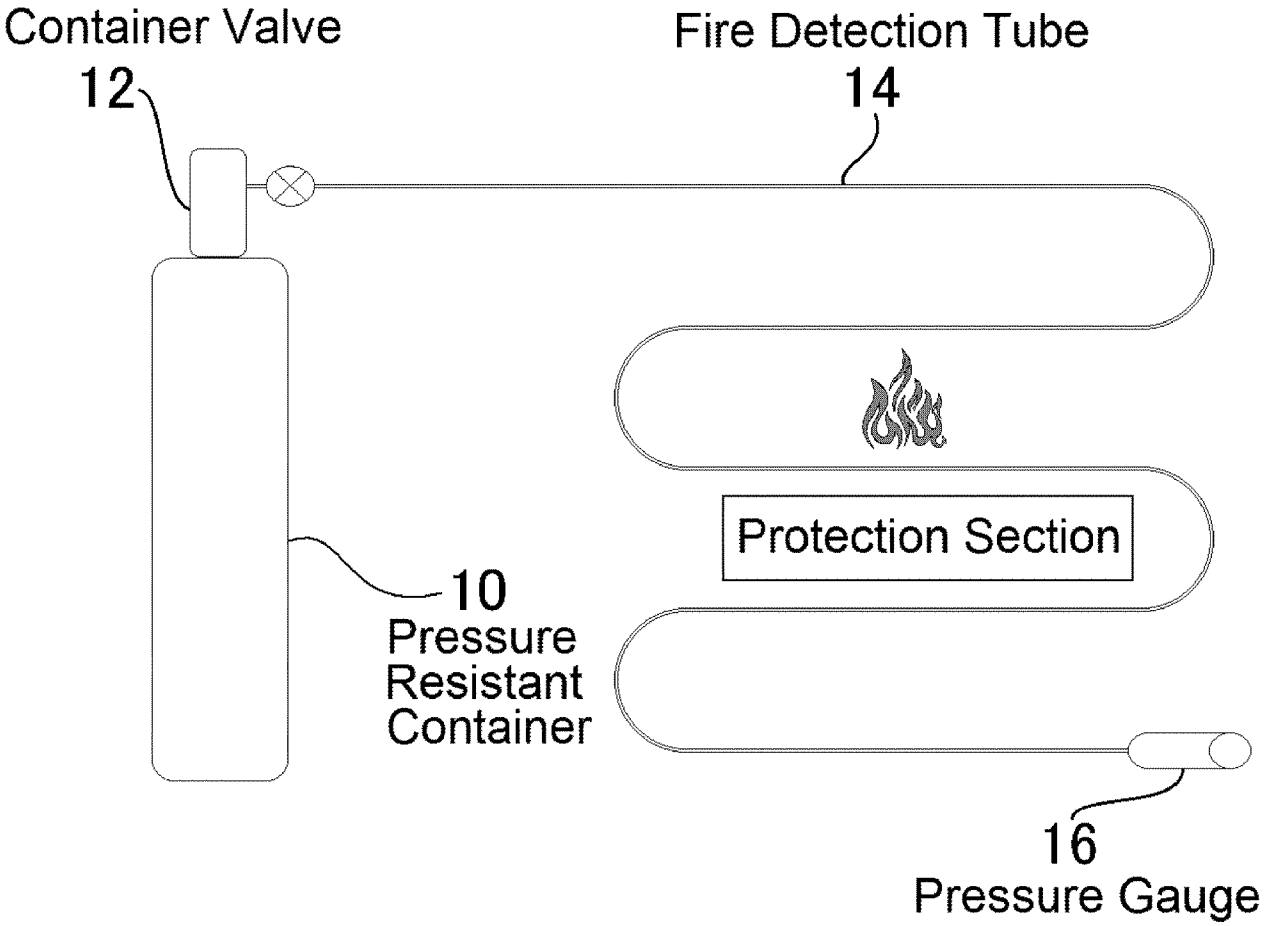
FIG. 5 is an illustration indicating the setting example of the automatic fire extinguishing device of the direct system.
Figure 6:
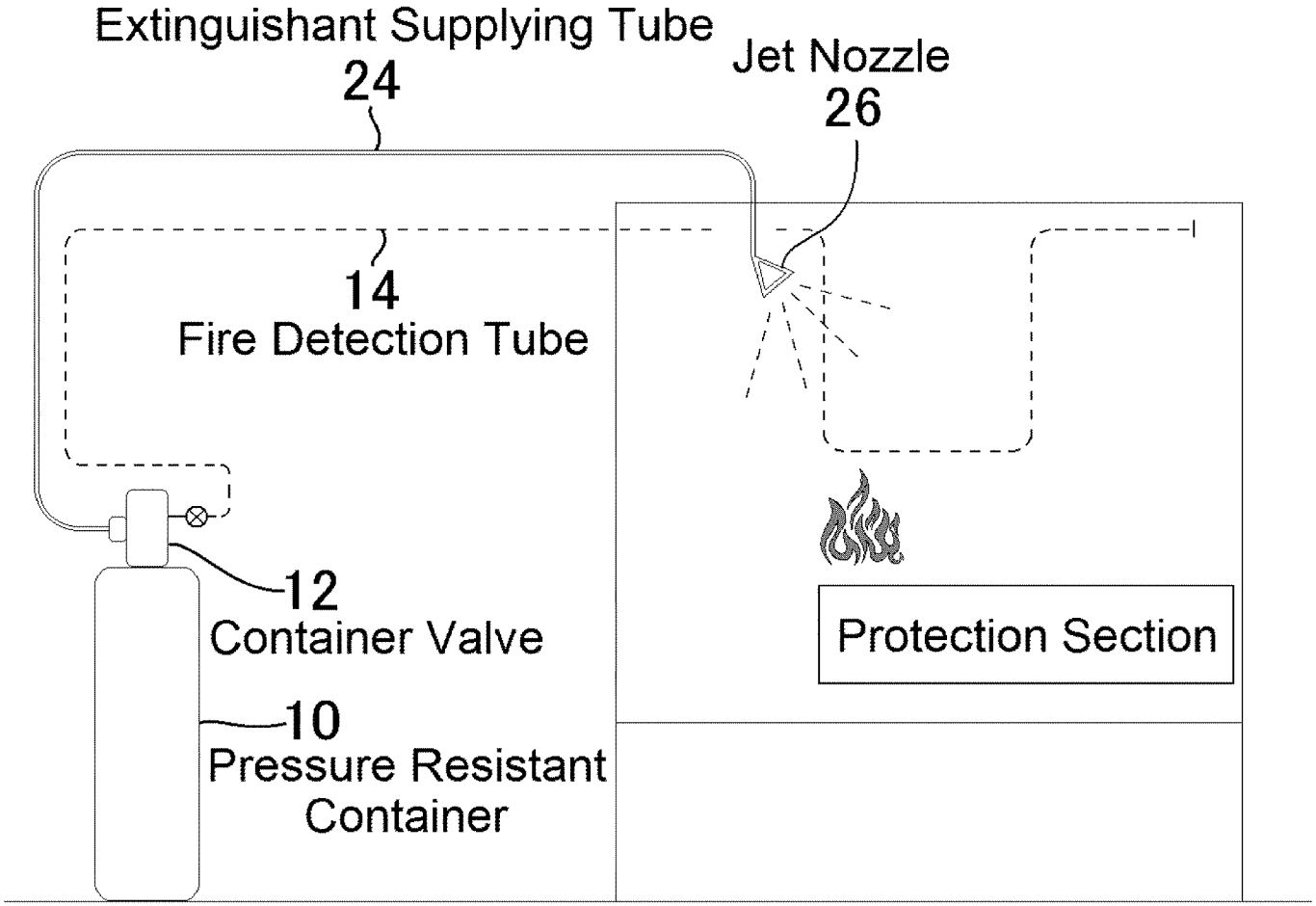
FIG. 6 is an illustration indicating the setting example of the automatic fire extinguishing device of the indirect system.

(3) The Relationship Between the Thickness and the Inner Pressure of the Gas Barrier Layer Consisting of EVOH Resin After trying to obtain a relationship between the lapse of time (years) and the inner pressure of the gas barrier layer consisting of the EVOH resin by changing the thickness of the gas barrier layer consisting of the EVOH resin gradually from 0.002 mm, 0.005 mm, 0.02 mm to 0.1 mm, then the result is as indicated on FIG. 4.

According to the result indicated on FIG. 4, it is preferable that the range of the thickness of the gas barrier layer is between 0.005 mm and 0.02 mm because if the thickness of the gas barrier layer is between 0.005 mm and 0.02 mm, the fall of the inner pressure is small. However, even if the range of the thickness of the gas barrier layer is less than 0.005 mm, it can be used depending on the condition because when the range of the thickness of the gas barrier layer is between 0.005 and 0.002 mm, the fall of the internal pressure is smaller than that of the fire detection tube consisting of the PA resin.

In addition, at the above embodiment example the fire detection tube of which outer diameter is 6 mm, the inner diameter is 4 mm and the thickness of the gas barrier layer is 0.002~0.1 mm, is used. But as for the fire detection tube, if the tube is too thick or the thickness of the gas barrier layer is too big, it is difficult to install it in the small space such as the inside of the engine room of the car or the switchboard. Therefore the inner and outer diameters of the fire detection tube and the thickness of the gas barrier layer should be designed properly based on the above viewpoints.

Embodiment 2

At the above embodiment 1, the EVOH resin was used as the material of the gas barrier layer, but the permeance experiment was done by making a fire detection tube using the aluminum film as the gas barrier layer instead of the EVOH resin because the transmissivity of the pressurization gas (nitrogen gas) of the aluminum film is so low that it might be said it is nearly zero in comparison with the EVOH resin. And the same result as the experiment of the embodiment 1 using the fire detection tube is obtained.

INDUSTRIAL APPLICABILITY OF THE INVENTION

The present invention of this automatic fire extinguishing device is applicable to use not only to extinguish a fire caused by a lithium ion battery installed in the car but also to extinguish a fire of the switchboard, the distribution board, the electricity board, the server rack, the dust collector, the NC lathe, the grinder, various machine tools, the storage of inflammables, the chemical experimental device, the fireproof safekeeping, the important documents library, oil storehouse et al.

EXPLANATION OF THE MARK

10: PRESSURE RESISTANT CONTAINER
12: CONTAINER VALVE
14: FIRE DETECTION TUBE
16: PRESSURE GAUGE
18: GAS BARRIER LAYER
20: ADHESIVE LAYER
22: BASE RESIN LAYER

The invention claimed is:

1. An automatic fire extinguishing device is characterized in that it contains a pressure resistant container which includes an extinguishant and a pressurization agent inside, a container valve attached to an opening of the pressure resistant container, a fire detection tube connected to the container valve, the fire detection tube equipped with a tubular base layer and a gas barrier layer laminated coaxially with the tubular base resin layer, the tubular base resin layer which is comprising thermoplastic resin, the gas barrier layer consisting of ethylene-vinyl alcohol copolymer resin (EVOH resin), wherein a thickness of the gas barrier layer is within a range from 0.005 mm to 0.1 mm and a thickness of the tubular base resin layer is within a range from 1 mm to 2 mm.

2. The automatic fire extinguishing device described in claim 1 characterized by the gas barrier layer being sandwiched by the tubular base resin layer, or the gas barrier layer being laminated on one side of the tubular base resin layer.

3. The automatic fire extinguishing device described in claim 1 characterized by the gas barrier layer and the tubular base resin layer being laminated through adhesive layers.

4. A fire detection tube of an automatic fire extinguishing device characterized in that it contains a tubular shaped base resin layer and a gas barrier layer laminated coaxially with the tubular shaped base resin layer, the tubular shaped base resin layer consisting of thermoplastic resin, the gas barrier layer consisting of EVOH resin, wherein a thickness of the gas barrier layer is within a range from 0.005 mm to 0.1 mm and a thickness of the tubular shaped base resin layer is within a range from 1 mm to 2 mm.

5. The fire detection tube of the automatic fire extinguishing device described in claim 4 characterized by the gas barrier layer being sandwiched by the tubular shaped base resin layer or the gas barrier layer being laminated on one side of the tubular shaped base resin layer.

6. The fire detection tube of the automatic fire extinguishing device described in claim 4, characterized by the gas barrier layer and the tubular shaped base resin layer being laminated through an adhesive layer.

* * * * *